US005778704A

United States Patent [19]

Jonsson

[11] Patent Number: 5,778,704

[45] Date of Patent: Jul. 14, 1998

[54] ARRANGEMENT FOR A CONTINUOUS DIFFUSER FOR WASHING PULP

[75] Inventor: Allan Jonsson, Kil, Sweden

[73] Assignee: Kvaerner Pulping AB, Karlstad, Sweden

[21] Appl. No.: 765,579

[22] PCT Filed: Jun. 12, 1995

[86] PCT No.: PCT/SE95/00700

§ 371 Date: Dec. 27, 1996

§ 102(e) Date: Dec. 27, 1996

[87] PCT Pub. No.: WO96/01339

PCT Pub. Date: Jan. 18, 1996

[30] Foreign Application Priority Data

Jul. 4, 1994 [SE] Sweden ..... 9402360

[51] Int. Cl.[6] ..... D21D 5/02

[52] U.S. Cl. ..... 68/181 R; 162/60

[58] Field of Search ..... 68/181 R, 18 F; 162/60, 251; 8/156; 210/253, 388, 323.2, 333.01

[56] References Cited

U.S. PATENT DOCUMENTS

| | | | |
|---|---|---|---|
| 3,192,718 | 7/1965 | Bieri | 60/387 |
| 3,815,386 | 6/1974 | Gullichsen et al. | 68/181 R |
| 4,368,628 | 1/1983 | Jacobsen | 68/181 R |
| 4,375,410 | 3/1983 | Richter et al. | 210/323.2 |
| 4,827,741 | 5/1989 | Luthi | 68/181 R |
| 5,027,620 | 7/1991 | Richter | 68/181 R |
| 5,560,229 | 10/1996 | Jonsson et al. | 68/181 R |

FOREIGN PATENT DOCUMENTS

| | | | |
|---|---|---|---|
| 18562 | 11/1980 | European Pat. Off. | 68/181 R |
| 0 377 427 | 7/1990 | European Pat. Off. . | |
| 28 05 455 | 8/1978 | Germany . | |

*Primary Examiner*—Amy B. Vanatta
*Attorney, Agent, or Firm*—Dorsey & Whitney LLP

[57] ABSTRACT

Arrangement for a continuous diffuser for washing pulp, comprising a number of hydraulic cylinders distributed in a ring, arranged so as to repeatedly raise and then lower a screen assembly which is included in the diffuser. The characterizing feature of the invention is that groups of two or more hydraulic cylinders which lie adjacent to each other in the ring are coupled in parallel with each other, but in series with the next group of adjacent hydraulic cylinders which are also coupled in parallel, so that each group of parallel-coupled hydraulic cylinders is coupled in series with the next group of parallel-coupled hydraulic cylinders.

30 Claims, 4 Drawing Sheets

ARRANGEMENT FOR A CONTINUOUS DIFFUSER FOR WASHING PULP

TECHNICAL FIELD

The invention relates to an arrangement for a continuous diffuser for washing pulp, comprising a number of hydraulic cylinders distributed in a ring, arranged so as to repeatedly raise and then lower a screen assembly which is included in the diffuser.

PRIOR ART

The washing of paper pulp for the purpose of removing undissolved residues of wood and chemicals, for example after cooking and bleaching, can take place in a so-called continuous diffuser. The washing is in this case effected by means of the pulp being pumped into the bottom of a tank and moving upwards in the latter. The liquid with dissolved wood residues and chemicals which surrounds the pulp runs into, and is pressed out in, a screen assembly which is situated in the diffuser and which moves upwards at approximately the same speed as the pulp, while at the same time washing liquid is conveyed to the pulp in connection with the screen assembly. When the screen assembly has reached its uppermost position, it is drawn quickly down to its lowest position, after which the procedure is repeated.

The screen assembly consists of screen elements made of metal, carried by radial support arms, arranged in concentric rings with diameters of, at present, up to about 9 m. On account of the size, weight and structure of the screen assembly, it is sensitive to uneven loads which can lead to damage and/or operational shutdown. The movement of the screen assembly is effected with the aid of a plurality of double-acting hydraulic cylinders which are distributed in a ring and whose upper piston rods are connected to the radial supporting arms of the screen assembly.

In order to obtain a simultaneous parallel movement of the hydraulic cylinders, these are coupled in series, in one or more circuits. The alternative involving a purely parallel coupling of the hydraulic cylinders means that a drop in pressure in the conduits of the hydraulic system has a greater effect, necessitates simultaneous valve movements in the hydraulic system, and therefore places greater demands on monitoring equipment. Depending on the size of the screen assembly, the number of hydraulic cylinders used at present is either three, four or six. If there are three hydraulic cylinders in the diffuser, these are coupled in series; if there are four, they are coupled 2 by 2, i.e. two circuits of two series-coupled hydraulic cylinders. If there are six, they are coupled 2 by 3, i.e. two circuits of three series-coupled hydraulic cylinders.

In a series-coupled circuit of hydraulic cylinders, the compressibility of the hydraulic medium leads to the hydraulic cylinders situated in the middle, if there are more that two of them, working with less power than the first and last, on account of the compressibility of the hydraulic medium. In addition, leakage in a hydraulic cylinder can result in its not participating in the work at all, or only to a very small degree. This leads to overloading of the radial supporting arms which lie nearest the region to which the leaking hydraulic cylinder is connected. The compressibility of the hydraulic medium and possible leakage in the hydraulic cylinders thus leads to stresses in the screen assembly and its radial supporting arms during the upward and downward movements of the said screen assembly, and can additionally lead to damage or to the movement of the screen assembly being arrested, with operational shutdown as a consequence.

The downward movement of the screen assembly is rapid, in order among other reasons to clear the screens of pulp by means of so-called back-flushing. In order to slow down this movement before the hydraulic pistons have reached their lowest position, the movement of the hydraulic pistons is slowed down by means of the lower part of the hydraulic pistons and the hydraulic cylinders being designed as brake chambers. The brake chambers have very small mechanical tolerances, and it is for this reason, and on account of temperature variations and the compressibility of the hydraulic medium, that the slowing down can differ between the brake chambers of different hydraulic cylinders, which fact also leads to stresses in the screen assembly and its supporting arms.

SUMMARY OF THE INVENTION

One object of the invention is to eliminate or to substantially reduce the abovementioned problems. This can be achieved by virtue of the fact that two hydraulic cylinders which lie adjacent to each other in the ring are coupled in parallel with each other, but in series with the next pair of adjacent hydraulic cylinders which are also coupled in parallel, so that each pair of parallel-coupled hydraulic cylinders is coupled in series with the next pair of parallel-coupled hydraulic cylinders. The construction is such that the two parallel-coupled hydraulic cylinders in each pair are the equivalent of a single hydraulic cylinder working midway between the two actually existing cylinders. A construction with six hydraulic cylinders thus comes to act as a hypothetical three-cylinder construction with reduced sensitivity to leakage in an individual cylinder in the pair. This results in a more uniform operation between the hydraulic cylinders, with less sensitivity to leakage and to the compressibility of the hydraulic medium, with reduced stresses on the screen assembly and its radial supporting arms as a consequence.

The number of radial supporting arms in the screen assembly varies in accordance with the size of the continuous diffuser. The larger the diffuser, the more supporting arms are needed for the mechanical stability of the screen assembly and for managing the movement of liquid to and from the screen assembly. The number of radial supporting arms in the present invention is an even one, specifically four or six, in order among other reasons to gain full advantage of the abovementioned parallel coupling in accordance with the present invention.

The hydraulic cylinders in the present invention are double-acting, i.e. they manage both the upward and the downward movement of the screen assembly. The speed of the upward movement of the hydraulic pistons is such that the screen assembly is moved upwards slightly faster than the upward movement of the pulp in the diffuser, i.e. it takes about one minute from its lowest to its uppermost position. The speed of the downward movement of the hydraulic pistons is such that it takes less than one second from its uppermost position to its lowest position.

Another object of the invention is to equalize the slowing down of the hydraulic pistons at the end of their rapid downward movement. This is achieved by coupling together the brake chambers formed at the bottom of the hydraulic cylinders between the two hydraulic cylinders in each pair of parallel-coupled, adjacent hydraulic cylinders in accordance with the above, which results in a more even slowing down between neighbouring hydraulic cylinders and therefore less stress on the screen assembly and its supporting arms.

Further characteristics, aspects and advantages of the invention are evident from the following description of an embodiment and from the attached patent claims.

DETAILED DESCRIPTION

The production of paper pulp takes place in an aqueous phase. In constituent processes during production, parts of the wood are dissolved under the action of chemicals, inter alia. These wood residues and chemicals, and conversion products thereof, are left in the aqueous phase together with the pulp. In order to remove these, or, as we say, to wash the pulp, the impure aqueous phase which surrounds the pulp is replaced with a purer aqueous phase by means of the impure aqueous phase being allowed to run off or be pressed out, while at the same time a purer aqueous phase is supplied. This is carried out in, for example, presses, on rotating filters, or in a so-called continuous diffuser. The present invention relates to an arrangement for a continuous diffuser for washing pulp, comprising a number of hydraulic cylinders distributed in a ring, and arranged so as to repeatedly raise and then lower a screen assembly which is included in the diffuser.

Figure 1:
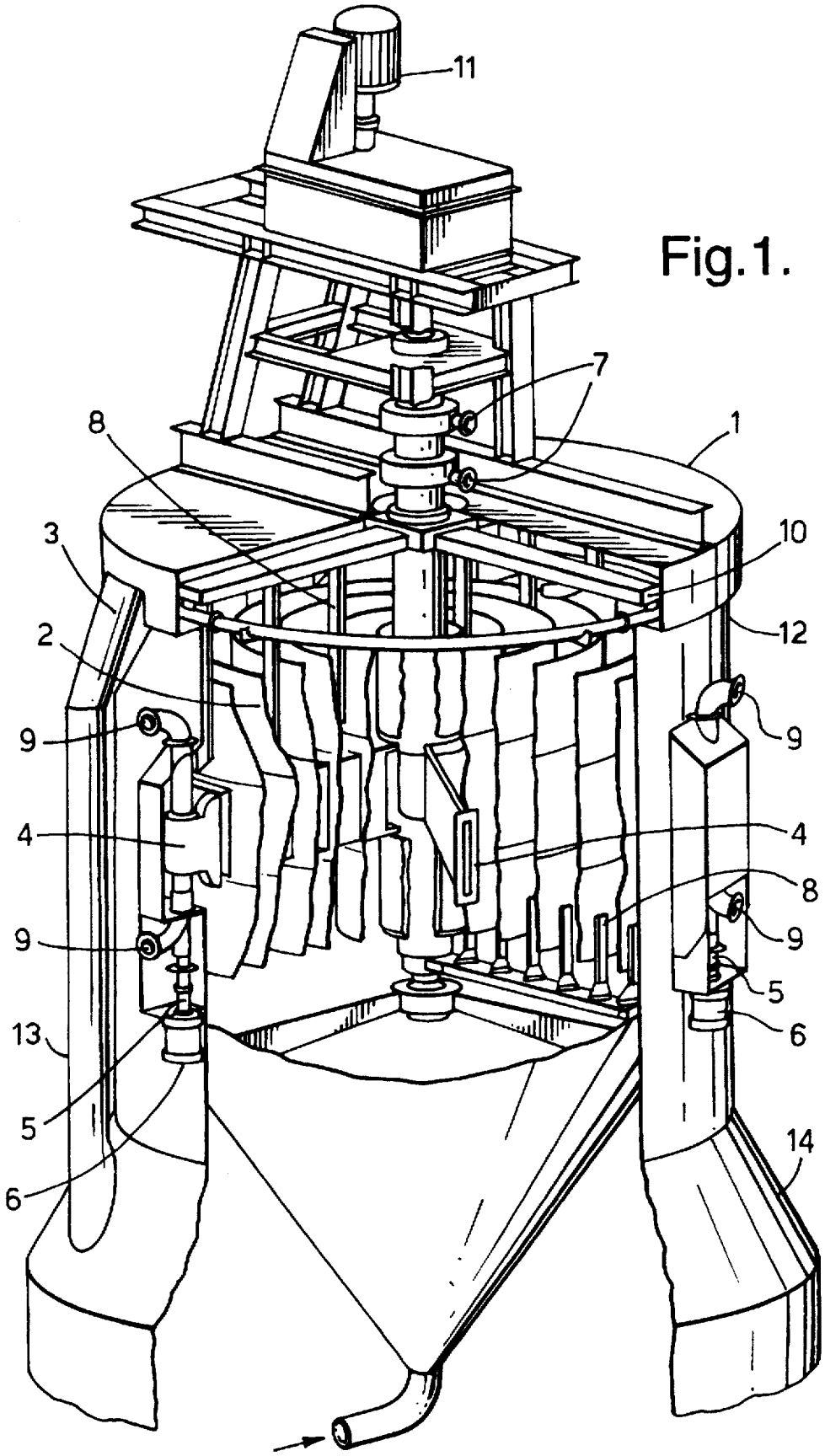
FIG. 1 shows the diffuser in a cutaway view.

FIG. 1 shows a continuous diffuser 1 in which the pulp is pumped into the bottom and moves upwards in the latter. The diffuser contains a screen assembly 2 which is movable in the vertical direction and which consists of a number of concentric screen rings 3 joined together by radial supporting arms 4. The piston rods 5 on the hydraulic cylinders 6 are connected to the supporting arms 4. Washing liquid is supplied through the washing-liquid inlets 7 and is spread out, by means of rotating devices 8, between the concentric screens 3 in the screen assembly 2. Impure liquid is drawn off from the screen assembly 2 through the supporting arms 4 and out through the outlet nozzles 9. The purified pulp is removed at the top of the diffuser by means of the pulp being fed by a rotating scraper 10, driven by the motor 11, into a channel 12, after which the pulp runs down through a shaft 13 to a storage container 14 or to a pump.

The liquid with dissolved wood residues and chemicals which surrounds the pulp runs into, and is pressed out in, a screen assembly 2 which is situated inside the diffuser 1. From its lowest position the screen assembly 2 moves upwards, at a slightly greater speed than that of the pulp, with the aid of the hydraulic cylinders 6 which are connected via their piston rods 5 to the supporting arms 4, while at the same time washing water is supplied to the pulp through devices 8 between the concentric screens 3 in the screen assembly 2, and at the same time as impure liquid is drawn off through the outlet nozzles 9. When the screen assembly 2 has reached its uppermost position, it is drawn quickly down to its lowest position by the hydraulic cylinders 6, at the same time as liquid is back-flushed through the screens. The movement is quick, and back-flushing is carried out in order to clear the screens of fibres and other solid impurities. The procedure is then repeated by means of the upward movement being begun again. The purified pulp is removed at the top of the diffuser by means of the pulp being fed by a rotating scraper 10 into a channel 12, after which the pulp runs down into a storage container 14, or to a pump.

In order to ensure that the hydraulic cylinders work simultaneously and uniformly, the hydraulic cylinders are coupled in series, two series if they are four or more in number. In theory, this means that each amount of liquid, in each of the series, which is forced down by the piston in the first hydraulic cylinder in the series, acts at the same time, and with the same amount, on the piston in the next hydraulic cylinder in the series, etc. With the exception of the compressibility of the oil, this guarantees parallel movement of the cylinders and consequently of the screen assembly, as long as none of the cylinders leaks. In order further to guarantee there is no inclined movement, the time difference between the times when the pistons reach their end positions is measured, inter alia, and these times may not exceed certain limit values, in which case the movement is arrested.

Figure 2:
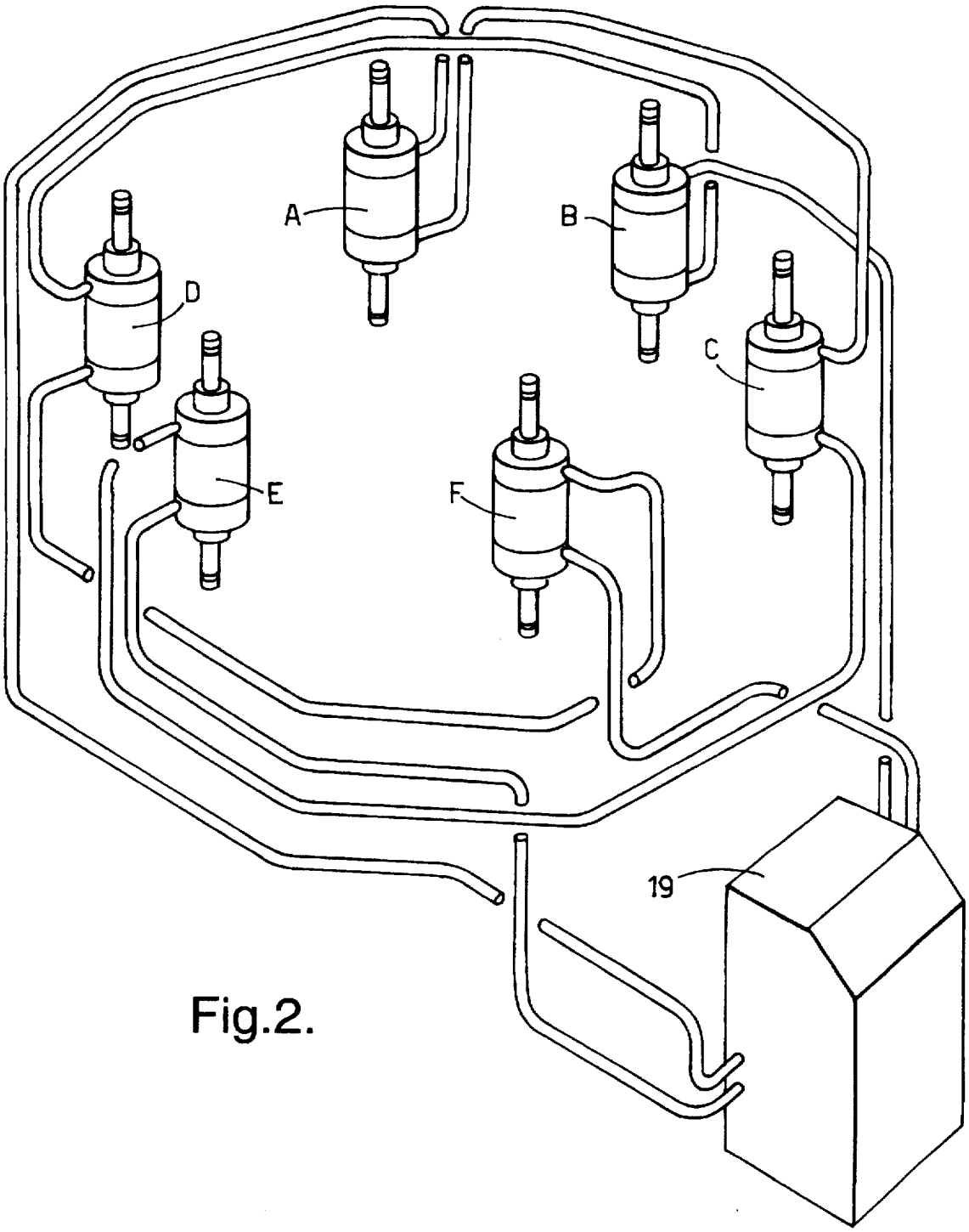
FIG. 2 shows the coupling of the hydraulic cylinders in a system with six hydraulic cylinders according to a previous design.

FIG. 2 shows an installation with six hydraulic cylinders A, B, C, D, E and F, fed from a hydraulic unit 19. When six hydraulic cylinders are used, these are coupled 2 by 3, i.e. in two series-coupled circuits with three hydraulic cylinders in each circuit, as per FIG. 2, in order to compensate for any differences in their manner of operation. As is clear from FIG. 2, the hydraulic cylinders A, C and E are coupled in series in one circuit, and the hydraulic cylinders B, D and F in series in the next circuit. The coupling is additionally configured such that the middle hydraulic cylinders C and D in each circuit, which cylinders work less efficiently than the others on account of the compressibility of the hydraulic medium, are placed straight opposite each other.

The downward movement of the screen assembly is rapid. In order to slow down this movement before the hydraulic pistons have reached their lowest position, the movement of the hydraulic pistons is slowed down by means of the lower part of the hydraulic pistons and the hydraulic cylinders being designed such that the flow of the hydraulic medium is reduced, by means of a throttle, before the hydraulic pistons have reached their lowest position. That part of the hydraulic cylinder which has been designed for throttling the flow of hydraulic medium, for the purpose of slowing down the rapid downward movement, is hereinafter referred to as the brake chamber.

The shortcomings of the known technique are therefore that the compressibility of the hydraulic medium leads to a situation where, in a series-coupled circuit of at least three hydraulic cylinders, those hydraulic cylinders situated in the middle work with less force than the first and last ones on account of the compressibility of the hydraulic medium. In addition, leakage in a hydraulic cylinder can result in its not participating at all in the work, or participating only very slightly. This leads to overloading of the radial supporting arms which lie nearest the region on which the leaking hydraulic cylinder acts. The compressibility of the hydraulic medium and possible leakage in the hydraulic cylinders thus leads to stresses in the screen assembly and its radial supporting arms during the upward and downward movements thereof, and can additionally lead to damage or to the movement of the screen assembly being arrested, with operational shutdown as a consequence.

The brake chambers additionally have small mechanical tolerances, and it is for this reason, and on account of temperature variations and the compressibility of the hydraulic medium, that the slowing down can differ between the brake chambers of different hydraulic cylinders, which fact also leads to stresses in the screen assembly and its supporting arms.

The couplings of the hydraulic cylinders which are described below eliminate or substantially reduce the above-mentioned problems.

DESCRIPTION OF A PREFERRED EMBODIMENT

Figure 3:
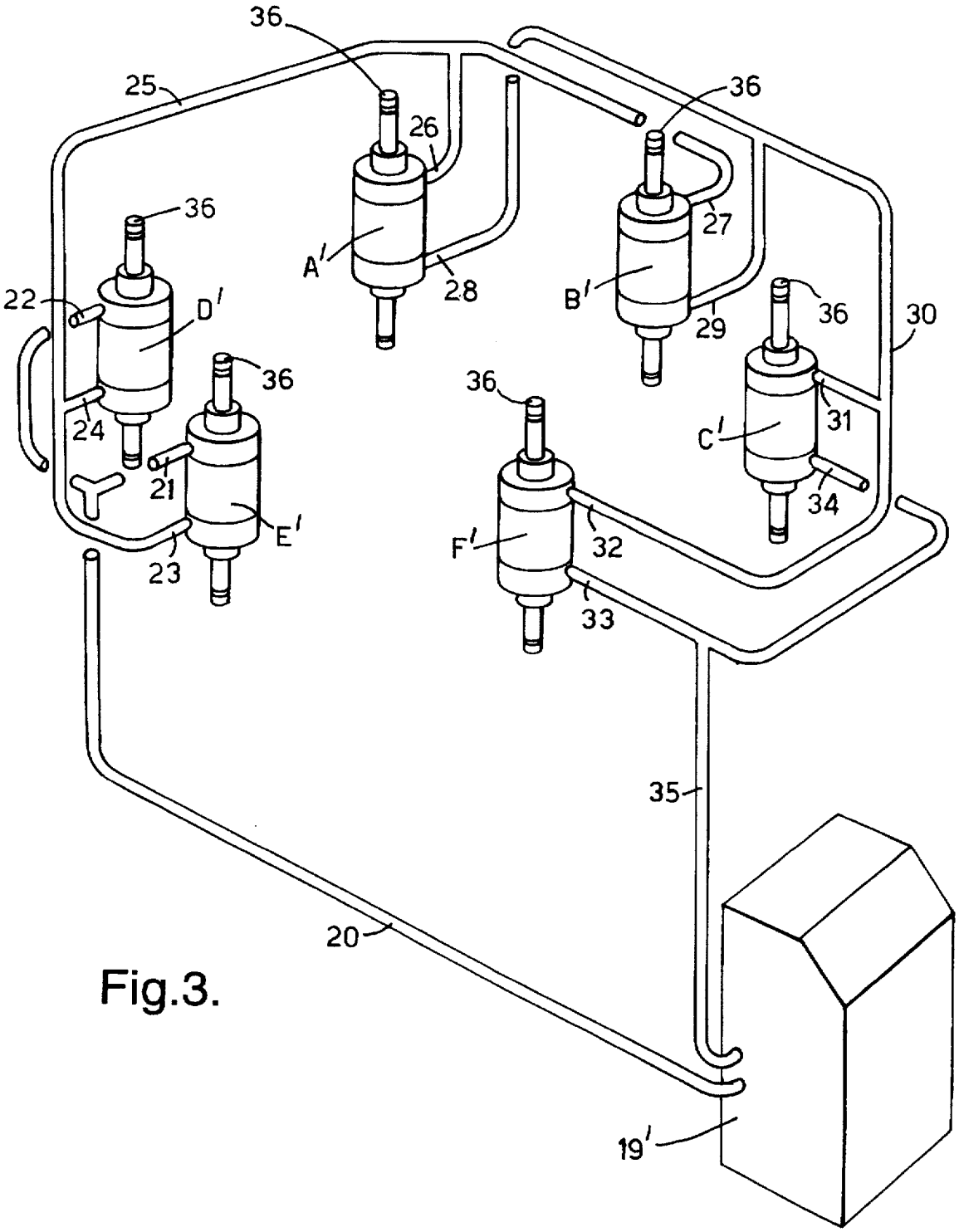
FIG. 3 shows the coupling of the hydraulic cylinders in a system with six hydraulic cylinders according to the invention.

FIG. 3 shows the preferred embodiment according to the invention, consisting of six double-acting hydraulic cylinders A', B', C', D', E' and F' which are coupled in pairs. The upper ends of the piston rods 36 are connected to the ends of the radial supporting arms of the screen assembly, directly or via chambers for conveying liquid to or from the screen assembly. The hydraulic cylinders A', B', C', D', E' and F' are connected to a hydraulic unit 19' via two conduits 35 and 20. Depending on which stage of the work cycle the installation is in, the conduits 35 and 20 are alternately a delivery conduit and a return conduit.

The conduit 20 is connected at one end to a hydraulic unit 19' and divides at its other end into two conduits 21 and 22, the conduit 21 connecting to the upper side of the hydraulic piston of the hydraulic cylinder E', and the conduit 22 connecting to the upper side of the hydraulic piston of the hydraulic cylinder D'. The conduit 23 connects to the underside of the hydraulic piston of the hydraulic cylinder E' and joins with the conduit 24 which is connected to the underside of the hydraulic piston of the hydraulic cylinder D'. The conduits 23 and 24 join to form the conduit 25. The conduit 25 divides at its other end into two conduits 26 and 27, the conduit 26 connecting to the upper side of the hydraulic piston of the hydraulic cylinder A', and the conduit 27 connecting to the upper side of the hydraulic piston of the hydraulic cylinder B'. The conduit 28 connects to the underside of the hydraulic piston of the hydraulic cylinder A' and joins with the conduit 29 which is connected to the underside of the hydraulic piston of the hydraulic cylinder B'. The conduits 28 and 29 join to form the conduit 30. The conduit 30 divides at its other end into two conduits 31 and 32, the conduit 31 connecting to the upper side of the hydraulic piston of the hydraulic cylinder C', and the conduit 32 connecting to the upper side of the hydraulic piston of the hydraulic cylinder F'. The conduit 34 connects to the underside of the hydraulic piston of the hydraulic cylinder C' and joins with the conduit 33 which is connected to the underside of the hydraulic piston of the hydraulic cylinder F'. The conduits 34 and 33 join to form the conduit 35, which connects to the hydraulic unit 19'.

During the upward movement of the screen assembly, in FIG. 3 the conduit 35 is the delivery conduit, and the pressure which the hydraulic unit 19' supplies is conveyed onwards to the hydraulic cylinders F' and C' by virtue of the fact that the delivery conduit 35 divides into the two conduits 33 and 34, the conduit 33 leading to the underside of the hydraulic piston in the hydraulic cylinder F', and the conduit 34 leading to the underside of the hydraulic piston in the hydraulic cylinder C'. The hydraulic pistons in the hydraulic cylinders F' and C' thus move upwards at the same time as the hydraulic oil at the top side of the hydraulic pistons in the hydraulic cylinders F' and C' is pressed out through respective conduits 32 and 31. These conduits 32 and 31 are joined together to form the conduit 30, which conduit 30, during the upward movement of the screen assembly, is the delivery conduit to the hydraulic cylinders B' and A'.

The conduit 30 divides into the two conduits 29 and 28 which are delivery conduits to the hydraulic cylinders B' and A', the conduit 29 leading to the underside of the hydraulic piston in the hydraulic cylinder B', and the conduit 28 leading to the underside of the hydraulic piston in the hydraulic cylinder A'. The hydraulic pistons in the hydraulic cylinders B' and A' thus move upwards by means of the hydraulic oil which is pressed out from the hydraulic cylinders F' and C', while at the same time the hydraulic oil at the top side of the hydraulic pistons in the hydraulic cylinders B' and A' is pressed out through respective conduits 27 and 26. These conduits 27 and 26 are joined together to form the conduit 25, which conduit 25, during the upward movement of the screen assembly, is the delivery conduit to the hydraulic cylinders D' and E'.

The conduit 25 divides into the two conduits 24 and 23 which are delivery conduits to the hydraulic cylinders D' and E', the conduit 24 leading to the underside of the hydraulic piston in the hydraulic cylinder D', and the conduit 23 leading to the underside of the hydraulic piston in the hydraulic cylinder E'. The hydraulic pistons in the hydraulic cylinders D' and E' thus move upwards by means of the hydraulic oil which is pressed out from the hydraulic cylinders B' and A', while at the same time the hydraulic oil at the top side of the hydraulic pistons in the said hydraulic cylinders D' and E' is pressed out through respective conduits 22 and 21. These conduits 22 and 21 are joined together to form the conduit 20, which conduit 20, during the upward movement of the screen assembly, is the return conduit to the hydraulic unit 19'.

During the downward movement of the screen assembly, in FIG. 3 the conduit 20 is the delivery conduit, and the pressure which the hydraulic unit 19' supplies is conveyed onwards to the hydraulic cylinders E' and D' by virtue of the fact that the delivery conduit 20 divides into the two conduits 21 and 22, the conduit 21 leading to the top side of the hydraulic piston in the hydraulic cylinder E', and the conduit 22 leading to the top side of the hydraulic piston in the hydraulic cylinder D'. The hydraulic pistons in the hydraulic cylinders E' and D' thus move downwards at the same time as the hydraulic oil at the underside of the hydraulic pistons in the hydraulic cylinders E' and D' is pressed out through respective conduits 23 and 24. These conduits 23 and 24 are joined together to form the conduit 25, which conduit 25, during the downward movement of the screen assembly, is the delivery conduit to the hydraulic cylinders A' and B'.

The conduit 25 divides into the two conduits 26 and 27, the conduit 26 leading to the top side of the hydraulic piston in the hydraulic cylinder A', and the conduit 27 leading to the top side of the hydraulic piston in the hydraulic cylinder B'. The hydraulic pistons in the hydraulic cylinders A' and B' thus move downwards by means of the hydraulic oil which is pressed out from the hydraulic cylinders E' and D', while at the same time the hydraulic oil at the underside of the hydraulic pistons in the hydraulic cylinders A' and B' is pressed out through respective conduits 28 and 29. These conduits 28 and 29 are joined together to form the conduit 30, which conduit 30, during the downward movement of the screen assembly, is the delivery conduit to the hydraulic cylinders C' and F'.

The conduit 30 divides into the two conduits 31 and 32, the conduit 31 leading to the top side of the hydraulic piston in the hydraulic cylinder C', and the conduit 32 leading to the top side of the hydraulic piston in the hydraulic cylinder F'. The hydraulic pistons in the hydraulic cylinders C' and F' thus move downwards by means of the hydraulic oil which is pressed out from the hydraulic cylinders A' and B', while at the same time the hydraulic oil at the underside of the hydraulic pistons in the hydraulic cylinders C' and F' is pressed out through respective conduits 34 and 33. These conduits 34 and 33 are joined together to form the conduit 35, which conduit 35, during the downward movement of the screen assembly, is the return conduit to the hydraulic unit 19'.

In the coupling arrangement described above, each pair of hydraulic cylinders A'+B', C'+F', and E'+D' comes to work with the same pressure at the inlet side and the same pressure at the outlet side, which means that each pair comes to work with the same power and with a mean value of both the hydraulic cylinders' efficiency, which also compensates for any differences between the pairs, which fact in turn makes possible the effects which have been discussed in the present account of the invention.

Figure 4:
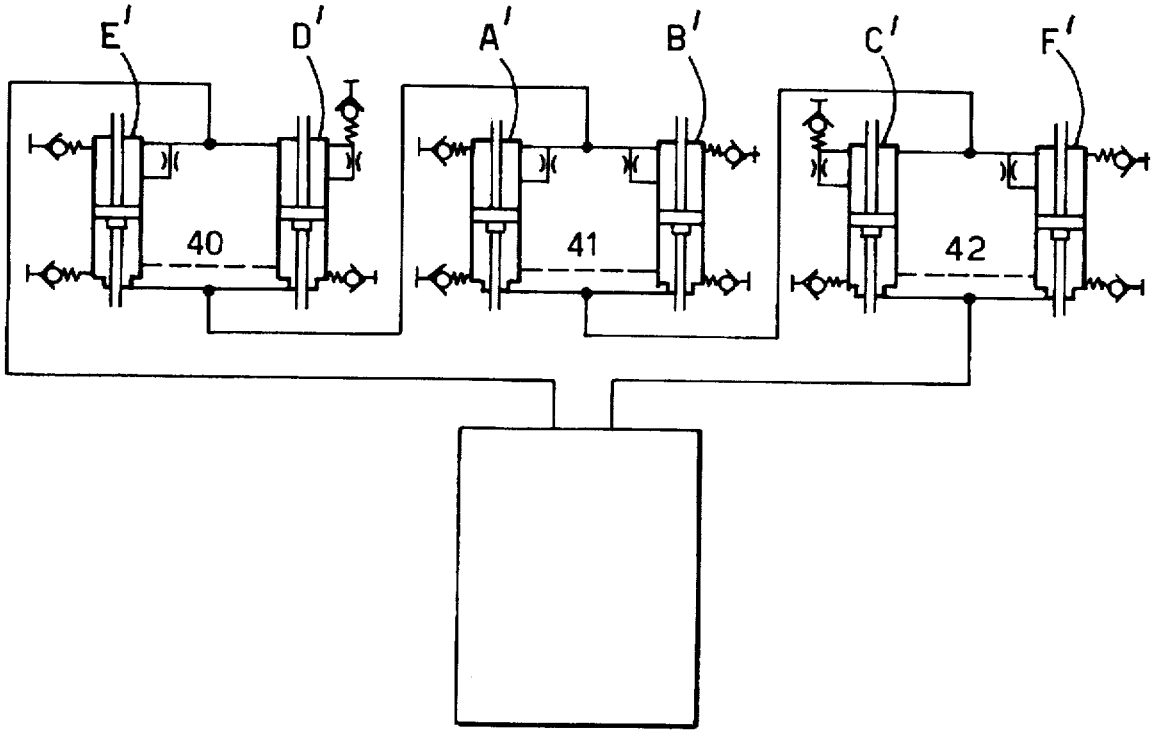
FIG. 4 shows diagrammatically the paired coupling of the brake chambers of the hydraulic cylinders.

FIG. 4 shows the coupling of the brake chambers according to the present invention. The brake chambers at the bottom of each hydraulic cylinder are coupled in pairs in the manner which is shown by the broken lines in FIG. 4, so that the brake chamber in the hydraulic cylinder E' is paired with the brake chamber in the hydraulic cylinder D' via the conduit 40, the brake chamber in the hydraulic cylinder A' is paired with the brake chamber in the hydraulic cylinder B' via the conduit 41, and the brake chamber in the hydraulic cylinder C' is paired with the hydraulic cylinder F' via the conduit 42. This paired coupling between the brake chambers of neighbouring hydraulic cylinders means that the pressures in the brake chambers are equal, which means on the one hand that the slowing down is equal in these two cylinders, and also results in a compensation of the slowing down between the different pairs of brake chambers and, therefore, a more even slowing down of the whole screen assembly, with less mechanical stressing as a consequence.

The foregoing is a complete description of the present invention. Changes and modifications by persons skilled in the art are contemplated.

What is claimed is:

1. Arrangement for a continuous diffuser for washing pulp, comprising a number of hydraulic cylinders distributed in a ring, arranged so as to repeatedly raise and then lower a screen assembly which is included in the diffuser, characterized in that groups of two or more hydraulic cylinders which lie adjacent to each other in the ring are coupled in parallel with each other, but in series with the next group of adjacent hydraulic cylinders which are also coupled in parallel, so that each group of parallel-coupled hydraulic cylinders is coupled in series with the next group of parallel-coupled hydraulic cylinders.

2. Arrangement according to claim 1, characterized in that the number of hydraulic cylinders in the ring is an even one.

3. Arrangement according to claim 2, characterized in that the number of hydraulic cylinders is 4 or 6.

4. Arrangement according to claim 1 characterized in that the hydraulic cylinders are double acting.

5. Arrangement according to claim 2 characterized in that the hydraulic cylinders are double acting.

6. Arrangement according to claim 3 characterized in that the hydraulic cylinders are double acting.

7. Arrangement according to claim 1 characterized in that the speed of the upward movement of the screen assembly takes about one minute from the lowest position to the uppermost position.

8. Arrangement according to claim 2 characterized in that the speed of the upward movement of the screen assembly takes about one minute from the lowest position to the uppermost position.

9. Arrangement according to claim 3 characterized in that the speed of the upward movement of the screen assembly takes about one minute from the lowest position to the uppermost position.

10. Arrangement according to claim 4 characterized in that the speed of the upward movement of the screen assembly takes about one minute from the lowest position to the uppermost position.

11. Arrangement according to claim 1 characterized in that the speed of the downward movement of the screen assembly takes less than about one second from the uppermost position to the lowest position.

12. Arrangement according to claim 2 characterized in that the speed of the downward movement of the screen assembly takes less than about one second from the uppermost position to the lowest position.

13. Arrangement according to claim 3 characterized in that the speed of the downward movement of the screen assembly takes less than about one second from the uppermost position to the lowest position.

14. Arrangement according to claim 4 characterized in that the speed of the downward movement of the screen assembly takes less than about one second from the uppermost position to the lowest position.

15. Arrangement according to claim 7 characterized in that the speed of the downward movement of the screen assembly takes less than about one second from the uppermost position to the lowest position.

16. Arrangement according to claim 1 characterized in that the screen assembly includes radial supporting arms which are connected to the hydraulic cylinders.

17. Arrangement according to claim 2 characterized in that the screen assembly includes radial supporting arms which are connected to the hydraulic cylinders.

18. Arrangement according to claim 3 characterized in that the screen assembly includes radial supporting arms which are connected to the hydraulic cylinders.

19. Arrangement according to claim 4 characterized in that the screen assembly includes radial supporting arms which are connected to the hydraulic cylinders.

20. Arrangement according to claim 7 characterized in that the screen assembly includes radial supporting arms which are connected to the hydraulic cylinders.

21. Arrangement according to claim 11 characterized in that the screen assembly includes radial supporting arms which are connected to the hydraulic cylinders.

22. Arrangement according to claim 1 including means for braking the lowering of the screen assembly at the end of the of the lowering of said screen assembly.

23. Arrangement according to claim 2 including means for braking the lowering of the screen assembly at the end of the of the lowering of said screen assembly.

24. Arrangement according to claim 3 including means for braking the lowering of the screen assembly at the end of the of the lowering of said screen assembly.

25. Arrangement according to claim 4 including means for braking the lowering of the screen assembly at the end of the of the lowering of said screen assembly.

26. Arrangement according to claim 7 including means for braking the lowering of the screen assembly at the end of the of the lowering of said screen assembly.

27. Arrangement according to claim 11 including means for braking the lowering of the screen assembly at the end of the of the lowering of said screen assembly.

28. Arrangement according to claim 16 including means for braking the lowering of the screen assembly at the end of the of the lowering of said screen assembly.

29. Arrangement according to claim 22 characterized in that said means for braking comprises at least one brake chamber.

30. Arrangement according to claim 22 characterized in that said means for braking includes at least one brake chamber associated with each hydraulic cylinder, said brake chambers coupled together in pairs corresponding to the pairs of parallel-coupled hydraulic cylinders.

* * * * *